US006851360B2

(12) United States Patent
Iwamloto

(10) Patent No.: US 6,851,360 B2
(45) Date of Patent: Feb. 8, 2005

(54) SATELLITE-TYPE PRINTING PRESS

(75) Inventor: Masayuki Iwamloto, Shizuoka (JP)

(73) Assignee: Shinohara Machinery Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/196,044

(22) Filed: Jul. 16, 2002

(65) Prior Publication Data

US 2004/0011229 A1 Jan. 22, 2004

(51) Int. Cl.[7] ..... B41M 1/14

(52) U.S. Cl. ..... 101/230; 101/229; 101/136; 101/409; 271/204; 271/277

(58) Field of Search ..... 101/229, 135, 101/136, 171, 174, 179, 180, 181, 183, 189, 190, 222, 223, 230, 232, 408, 409, 246; 271/277, 194, 195, 196, 204, 205, 206, 82, 85

(56) References Cited

U.S. PATENT DOCUMENTS 4,967,660 A * 11/1990 Yamanari et al. ..... 101/229
5,479,856 A * 1/1996 Wirz ..... 101/177
6,401,608 B1 * 6/2002 Lyon et al. ..... 101/136
6,438,352 B1 * 8/2002 Landa et al. ..... 399/401
6,571,706 B1 * 6/2003 Conzelmann et al. ..... 101/425
6,698,350 B2 * 3/2004 Iwamloto ..... 101/211

FOREIGN PATENT DOCUMENTS

JP 62169645 7/1987
JP 8244195 9/1996

* cited by examiner

*Primary Examiner*—Andrew H. Hirshfeld
*Assistant Examiner*—Kevin D. Williams
(74) *Attorney, Agent, or Firm*—Ladas & Parry LLP

(57) ABSTRACT

Sheet-fed printing press, especially a satellite-type printing press by which double-side printing is performed with a single satellite-type press and if only single-side printing is required a sheet perfecting apparatus does not intervene in the sheet transfer path. In the course of printing with a plurality of printing units (26) provided in satellite-like manner around a common pressure cylinder (10), a sheet perfecting apparatus (36) is provided for inverting the sheet of material for double-side printing. The sheet perfecting apparatus is separable from the sheet transfer path for printing on one side only. The sheet perfecting apparatus is made up of a first transfer cylinder (38) a perfecting cylinder (40) and a second transfer cylinder (42).

17 Claims, 7 Drawing Sheets

SATELLITE-TYPE PRINTING PRESS

BACKGROUND OF THE INVENTION

1. Field of the Invention

The present invention relates generally to sheet-fed printing press, or more precisely, to such printing press with sheet perfecting apparatus.

2. Description of the Prior Art

Satellite-type printing press is known in which many printing units (four color units, for example) are provided in satellite-like manner around common pressure cylinder of large diameter. Such satellite-type printing press is a new step toward corresponding to the need of multi-sort short run printing.

In Japanese unexamined patent laid-open 244195/1996, a technique is disclosed in which a plurality of satellite-type printing presses are connected via sheet perfecting apparatus. According to the technique, four color printing is done on the surface of sheet by first satellite-type press and, after reversing the sheet, also four color printing is put on the opposite side of the sheet by the second satellite-type press.

From Japanese unexamined patent laid-open 169645/1987, for example, a technique is well known in which many printing units are connected in series and sheet perfecting apparatus is interposed therein.

It is true that both sides of sheet can be printed at one pass by the satellite-type printing press shown in before-mentioned Japanese unexamined patent laid-open 244195/1996, but the equipment is huge and switching of printing format is not at all flexible, as the technique presupposes two satellite-type printing units.

Also, before-mentioned sheet perfecting apparatus of series type printing press has a tendency to cause register error through gripping change of sheet, as the perfecting apparatus stays the sheet transfer path during one-side printing in which sheet perfecting is not needed.

SUMMARY OF THE INVENTION

In view of the above-described problems of the prior art technique, the present invention provides an improved satellite-type printing press and aims at enabling double-side printing by only one satellite-type printing press itself, and preventing register error without intervening with sheet transfer path in case sheet reversing is not needed.

In accordance with satellite-type printing press according to the present invention, in the course of printing units of one satellite-type press itself, sheet perfecting apparatus is provided which functions only in double-side printing for sheet reversing and, in case of one-side printing, does not intervene with sheet transfer path.

More concretely, satellite-type printing press according to the present invention comprises;

Common pressure cylinder with grippers for sheet transfer to which are connected sheet feeder in the upper stream of sheet transfer and sheet delivery in the lower stream, at least four sets of printing units which are provided in satellite-like manner around said common pressure cylinder, sheet perfecting apparatus which is provided in the course of printing units and separable from sheet transfer path, and said apparatus comprises, from the upper stream to the down stream of sheet transfer path, first transfer cylinder, perfecting cylinder and second transfer cylinder.

According to the present invention, double-side printing of, for example, two colors on surface as well as two colors on backside is possible by only one satellite-type press in which sheet perfecting apparatus is provided between second and third printing units.

In one-side printing, sheet perfecting apparatus does not intervene with sheet transfer path, therefore, high register accuracy is secured even in four color printing.

These and other objects of the present invention will become apparent from the following description with reference to the drawings. But, these show merely an embodiment of the present invention.

DESCRIPTION OF PREFERRED EMBODIMENT

Figure 1:
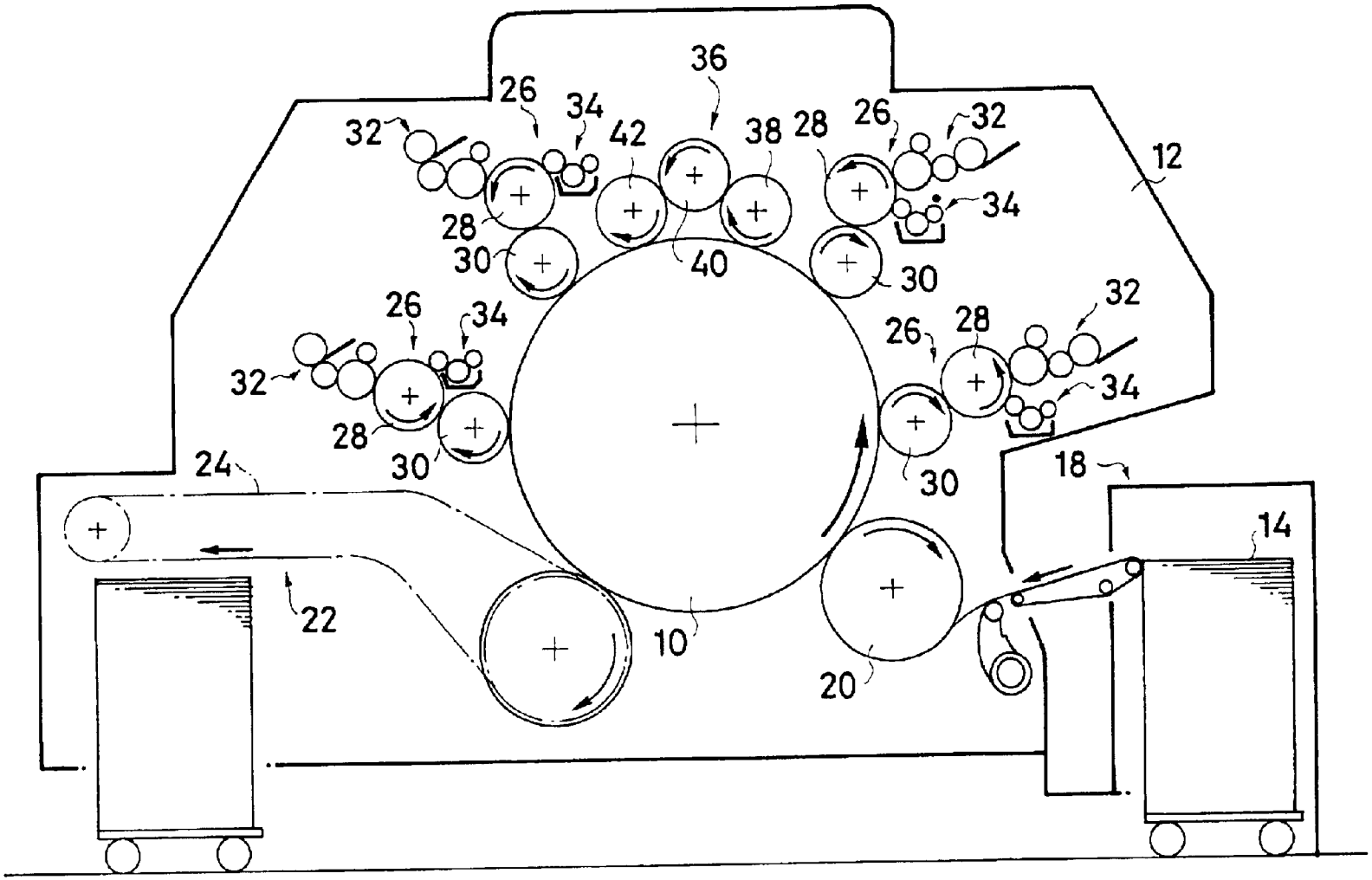
FIG. 1 is a schematic view showing an embodiment of satellite-type printing press according to the present invention.
Figure 2:
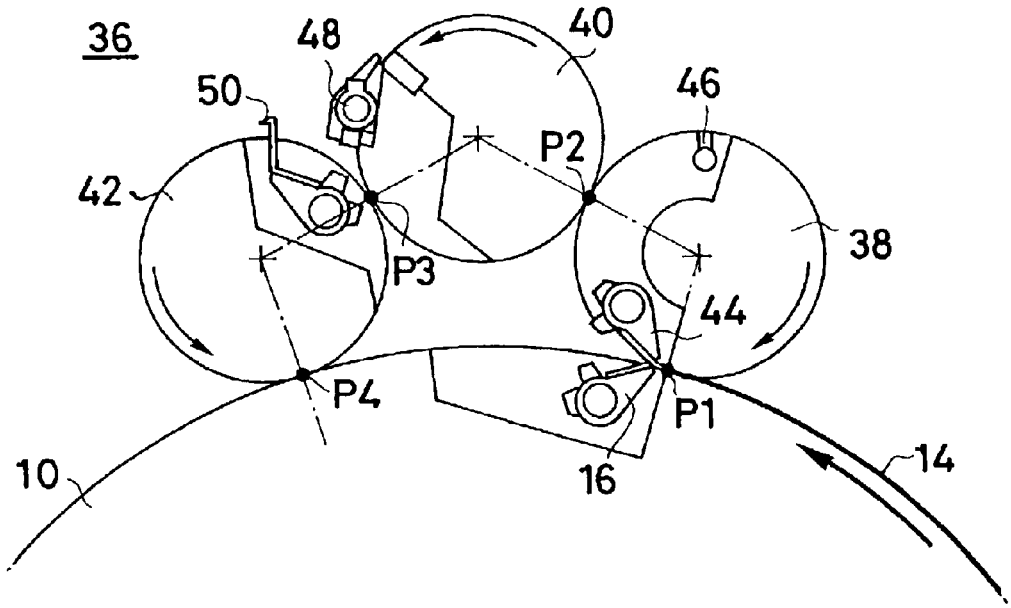
FIGS. 2 to 8 are functional illustrations of sheet perfecting apparatus provided in the satellite-type printing press according to the present invention.
Figure 3:
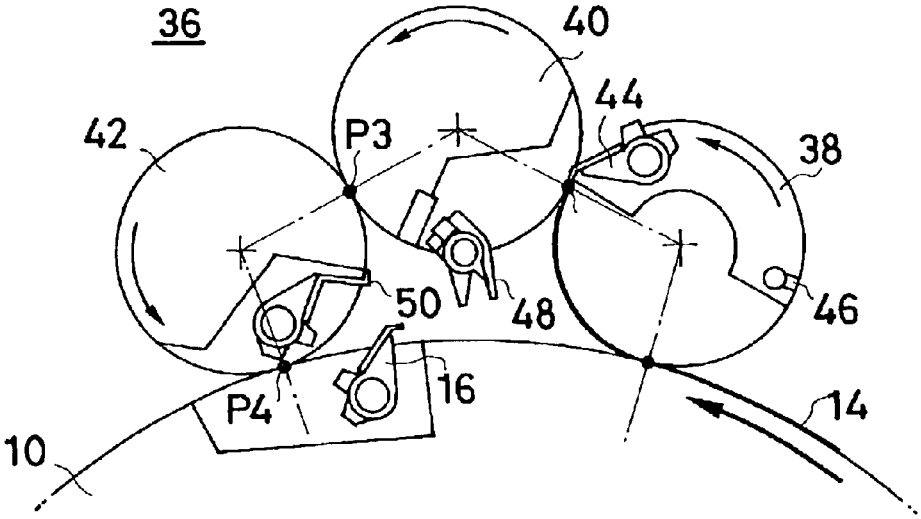

In the center of FIG. 1, common pressure cylinder 10 of relatively large diameter is shown which is rotatably supported between a pair of side frames 12 of printing press and is driven by motor (not shown). The common pressure cylinder 10 has, as shown in FIG. 2 and so on, grippers 16 which grip the end of sheet. The common pressure cylinder 10 is a base for accepting sheet 14 from feeding cylinder 20 of sheet feeder 18 in the upper stream and, after printing, for delivering the printed sheet to delivery chain 24 of sheet delivery device 22 in the lower stream.

Four sets of printing units 26 are provided in satellite-like manner around the common pressure cylinder 10. In order to perform offset printing, these printing units 26 have plate cylinder 28 equipped with printing plate and blanket cylinder 30 to transfer images. In addition, the plate cylinder 28 has inking device 32 and damping system 34. The diameter of the common pressure cylinder 10 around which printing units 26 are provided in satellite-like manner is integer times (for example, four times) as large as that of plate cylinder 28 in order to perform multi-color printing by these printing units 26 in compliance with the rotation of the common pressure cylinder 10 which is driven by motor (not shown).

Sheet perfecting apparatus 36 according to the present invention is provided between second and third printing units 26, basing upon rotational direction of common pressure cylinder 10 (counterclockwise in FIG. 1). From upper stream to down stream of sheet transfer path, the sheet perfecting apparatus 36 comprises first transfer cylinder 38, perfecting cylinder 40 and second transfer cylinder 42.

Figure 8:
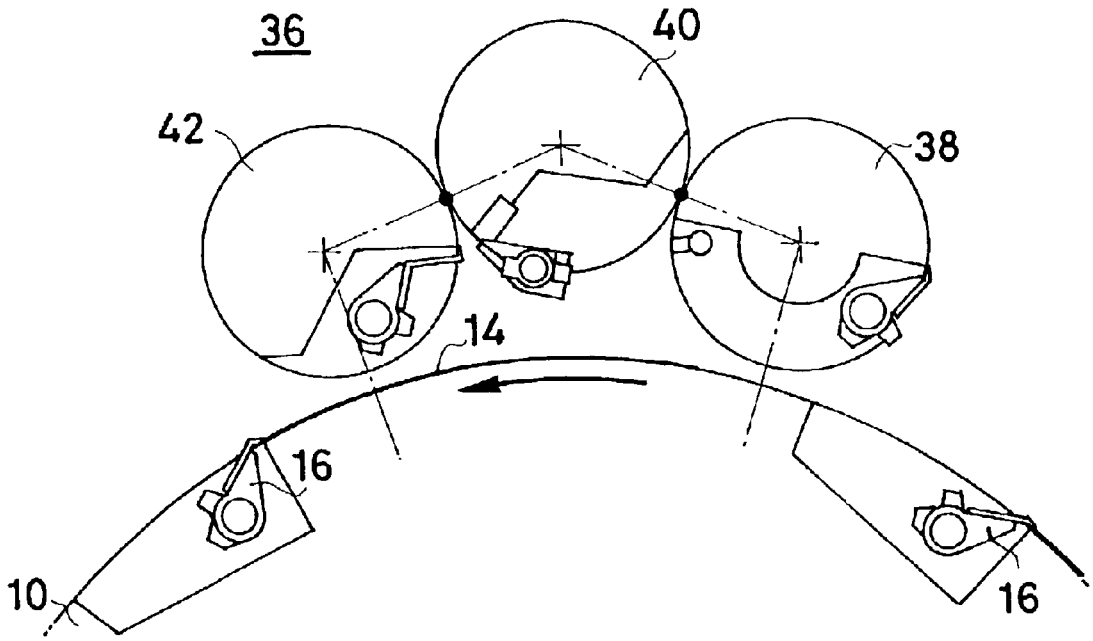

Such type of sheet perfecting apparatus 36 with three cylinders is well known in the prior art series-type printing press. Two transfer cylinders 38, 42 can, as shown in FIG. 8, be detachable from common pressure cylinder 10 by so-called cylinder throw-off. Needless to say, such cylinder throw-off (and throw-in as well) mechanism utilizing crank and cam is ordinarily equipped in blanket cylinder of offset press.

Next, sheet perfecting apparatus 36 is described with reference to functional illustrations of FIGS. 2 to 7. Two colors are printed on the surface of sheet 14 by blanket cylinder 30 of first and second printing units 26. Front end of sheet 14 is gripped by gripper 16 of common pressure cylinder 10 and then the front end is led to gripper 44 of first transfer cylinder 38 at opposing point P1 of common pressure cylinder 10 against first transfer cylinder 38 (FIG. 2).

Figure 4:
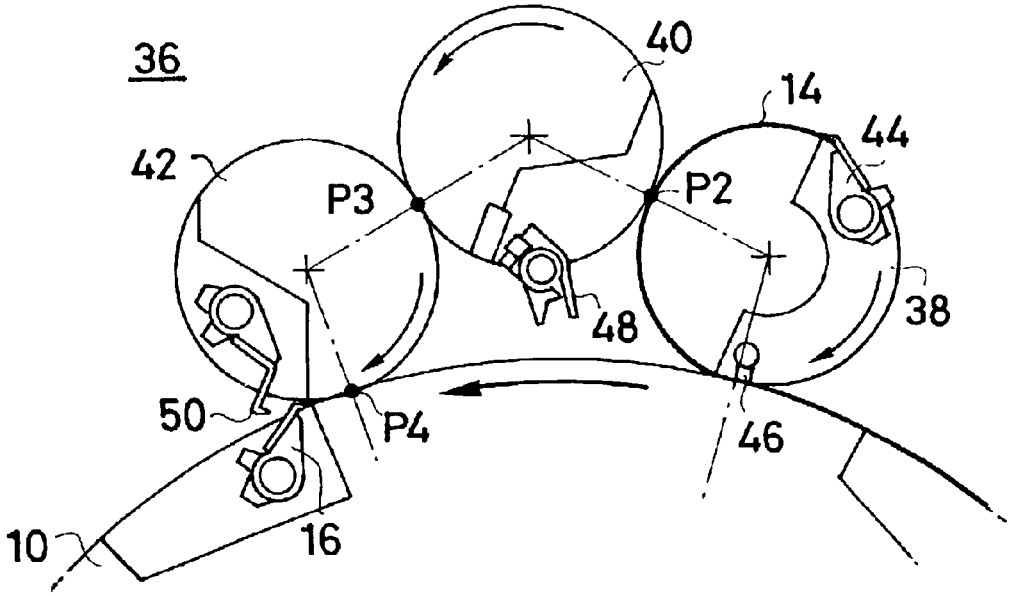
Figure 5:
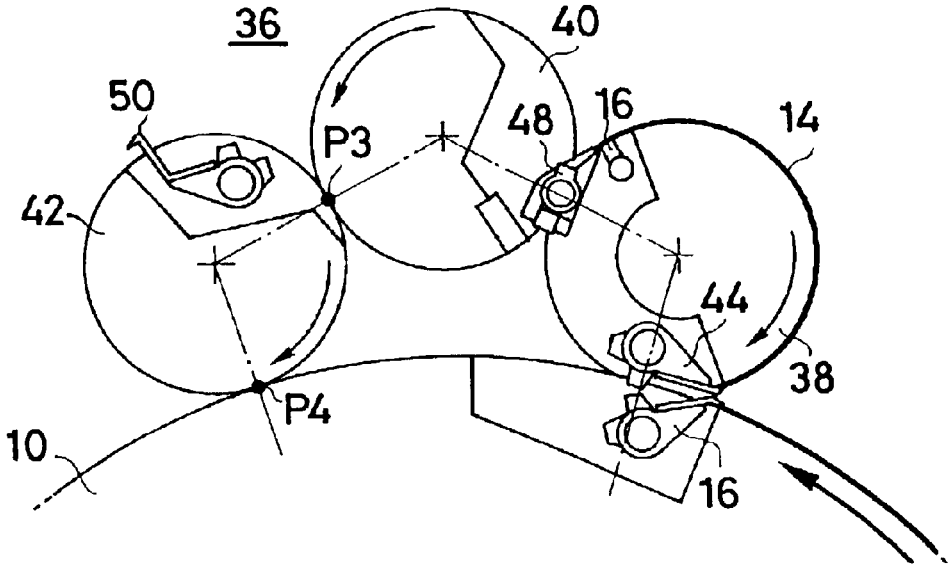
Figure 6:
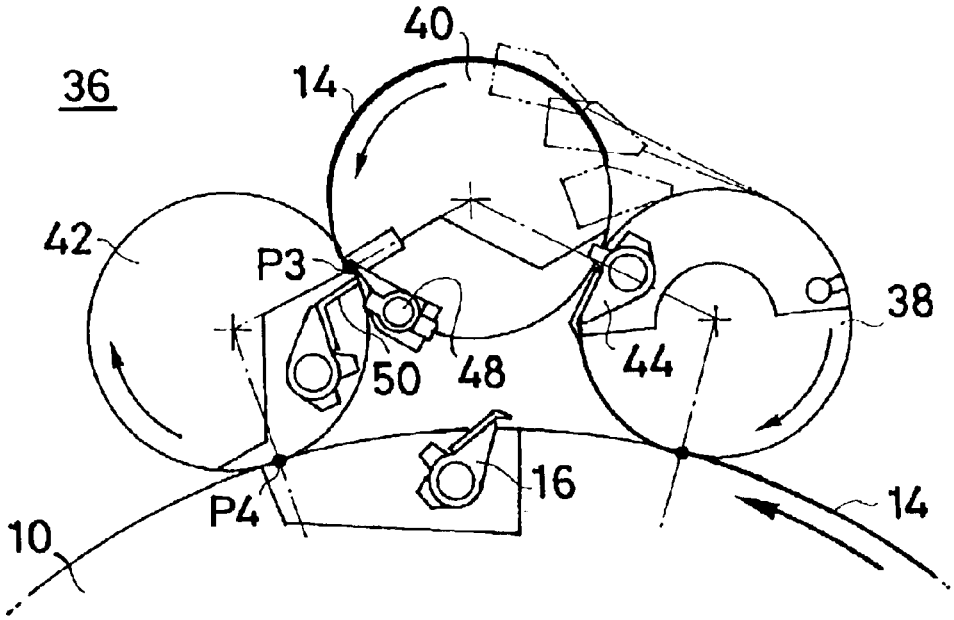

In accordance with the rotation of first transfer cylinder 38, front end reaches at opposing point P2 of first transfer cylinder 38 against perfecting cylinder 40 (FIG. 3), but sheet end is not transferred at this moment to perfecting cylinder 40 and rotation continues. Rear end of sheet 14 is sucked and broadened by sucker 46 (FIG. 4).

When rear end of sheet 14 reaches at opposing point P2 of perfecting cylinder 40, gripper 48 of perfecting cylinder 40 grips the rear end (FIG. 5) and, following the rotation of perfecting cylinder 40, sheet 14 is reversed.

Figure 7:
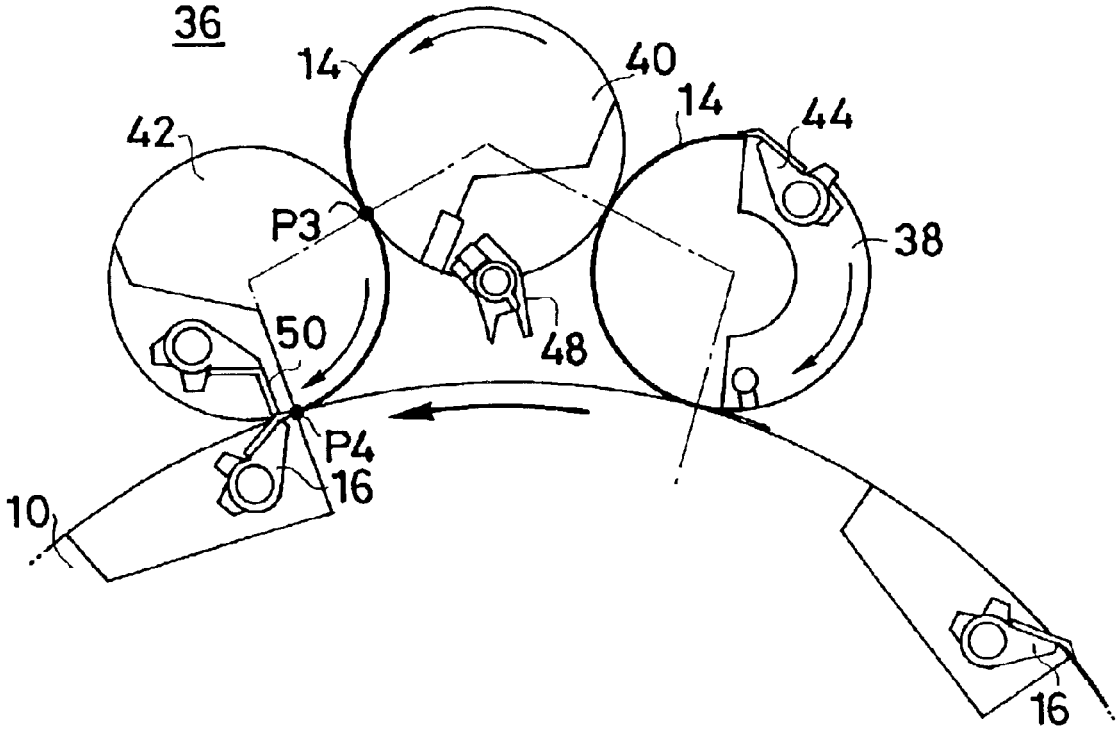

Reversed sheet 14 is then transferred to gripper 50 of second transfer cylinder 42 at opposing point P3 of perfecting cylinder 40 against second transfer cylinder 42 (FIG. 6) and further transferred to gripper 16 of common pressure cylinder 10 (FIG. 7).

Hereafter, third and fourth printing units 26 which are also provided in satellite-like manner around common pressure cylinder 10 further print on backside of sheet 14 which is already reversed by sheet perfecting apparatus 36 and finally double-side printing of two colors on surface as well as two colors on backside is completed.

In the foregoing descriptions, sheet 14 to be printed by satellite-type press according to the present invention is supposed to have a fixed length. But, sheet length (length of sheet 14 in its running direction.) is various and, under some conditions, sheet reversing pace must be raised in order to cope with printing speed. As described, press itself is, including each printing unit 26, timely driven by motor (not shown). To comply with sheet length variation to be printed, perfecting cylinder 40 of sheet perfecting apparatus 36 is preferably driven by servo motor (not shown) which is independent from motor of printing press. Further, servo motor speed is controlled in compliance with sheet length in its printing cycle so as to adapt sheet reversing pace to printing speed.

Figure 9:
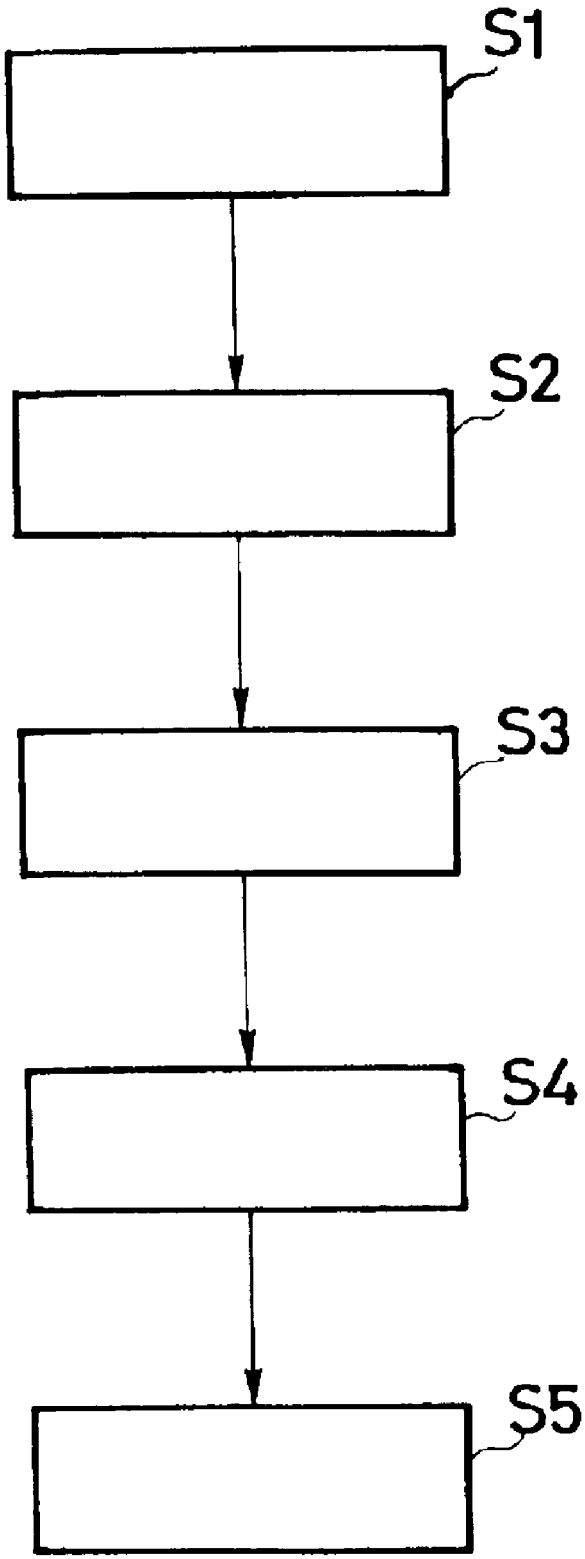
FIG. 9 is a block diagram for controlling the speed of perfecting cylinder in sheet perfecting apparatus.

FIG. 9 is a block diagram, showing speed control of perfecting cylinder 40 by independent servo motor. Rotation speed of printing press is always monitored by, for example, rotary encoder (Step 1). In addition, sheet length is, prior to printing, input into control console of press (Step 2). In control console, speed control data for servo motor of perfecting cylinder 40 is created in compliance with input sheet length (Step 3) and, receiving speed control data, rotation speed of servo motor is in- or decreased (Step 4). Finally, rotation speed of perfecting cylinder 40 is, in its one printing cycle, adjusted (Step 5).

Figure 10:
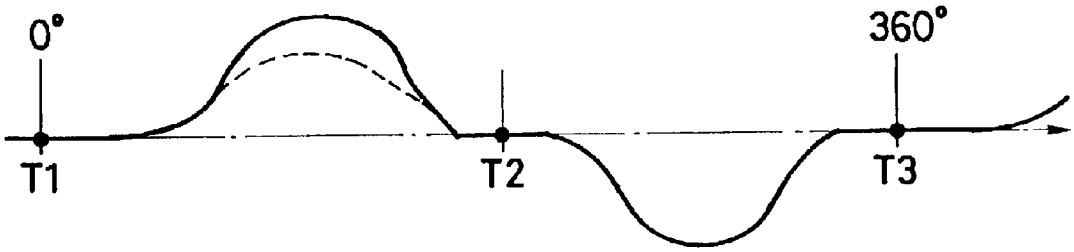
FIG. 10 is a speed diagram of perfecting cylinder in compliance with variation of sheet length.

FIG. 10 schematically shows rotation speed variation of perfecting cylinder 40 in compliance with sheet length variation. Lateral axis shows rotation mode in one printing cycle from 0 to 360 degree and longitudinal axis shows rotation speed of perfecting cylinder 40. In sheet receiving section T1 as well as sheet transferring section T2, relative speed of perfecting cylinder 40 in relation to first and second transfer cylinders 38, 42 is 0. But, after receiving sheet 14, rotation speed must be increased in compliance with sheet length in order to prepare sheet transfer. The case sheet length is long is shown in bold line and dot line shows the case sheet length is short.

According to the present invention, double-side printing of, for example, two colors on surface as well as two colors on backside can be done by only one satellite-type printing press. In surface printing (one-side printing), sheet perfecting apparatus does not intervene with sheet transfer path by so-called cylinder throw-off, therefore, high register accuracy is secured. Further, various sheet length can, without difficulty, be accepted.

The present invention is not limited to the embodiment described hitherto. Various changes and modifications can, of course, be made without departing from the spirit of the invention.

Description of the Reference Numerals

10 common pressure cylinder
14 sheet
16 gripper
18 sheet feeder
22 sheet delivery
24 delivery chain
26 printing unit
36 sheet perfecting apparatus
38 first transfer cylinder
40 perfecting cylinder
42 second transfer cylinder
44 gripper
46 sucker
48 perfecting gripper
50 gripper

What is claimed is:

1. A satellite-type printing press for selective two side printing of a sheet of material comprising:

a common pressure cylinder on which a sheet of material can be advanced from an upstream supply station to a downstream delivery station, first and second printing means angularly spaced around said common pressure cylinder for effecting color printing on said sheet of material while being advanced on said common pressure cylinder, and sheet perfecting apparatus disposed between said first and second printing means for inverting said sheet of material so that the first printing means prints on one side of said sheet of material and the second printing means prints on an opposite side of said sheet of material, said sheet perfecting apparatus being selectively separable from said common pressure cylinder whereby to enable said printing press to selectively effect one or two sided printing of said sheet of material, wherein said sheet perfecting apparatus comprises first and second sheet transfer cylinders and a sheet perfecting cylinder between said first and second sheet transfer cylinders, wherein after the first printing means has printed on a top surface of the sheet of material, a gripper on the first transfer cylinder grips a front end of the sheet of material to transfer the sheet of material thereon until a rear end of the sheet of material is adjacent to said perfecting cylinder whereupon a gripper on said perfecting cylinder grips the rear end of the sheet of material and advances the sheet of material, rear end first, in inverted condition to the second transfer cylinder which returns the sheet of material to the common pressure cylinder with a bottom surface of the sheet of material facing upwards for being printed by said second printing means.

2. The satellite-type printing press of claim 1, wherein said first and second transfer cylinders tangentially contact said common pressure cylinder and said perfecting cylinder is in tangential contact with said first and second transfer cylinders.

3. The satellite-type printing press of claim 1, wherein said perfecting cylinder and said first and second transfer cylinders travel at the same relative speed when the sheet of material is being transferred therebetween, and when the sheet of material is on said perfecting cylinder, the perfecting cylinder is driven at a speed corresponding to the length of the sheet of material whereby to enable the satellite-type printing press to print on sheets of material of different length.

4. The satellite-type printing press of claim 1, wherein said first transfer cylinder is provided with a suction opening to hold said rear end of the sheet of material against the first transfer cylinder.

5. A The satellite-type printing press of claim 1, wherein said first and second transfer cylinders rotate in a direction opposite said common pressure cylinder and said perfecting cylinder rotates in the same direction as said common pressure cylinder.

6. The satellite-type printing press of claim 1, wherein said first and second printing means respectively comprise a plurality of printing units for multiple printing on said sheet of material.

7. A method of color printing on two sides of a sheet of material by a single satellite type printing press comprising the steps of:

advancing a sheet of material on a common pressure cylinder from an upstream supply station to a downstream delivery station, printing in one or more colors on a topside surface of the sheet of material, transferring the sheet of material, now printed on its topside surface, to a perfecting cylinder in an inverted condition and transferring the sheet of material, in inverted condition from the perfecting cylinder back to the common pressure cylinder, and printing in one or more colors on an upwards facing bottom surface of the now inverted sheet of material, said sheet of material being transferred to and from said perfecting cylinder by first and second transfer cylinders respectively, wherein the sheet of material is transferred by the first transfer cylinder from the common pressure cylinder, after printing on the topside surface, to the perfecting cylinder in inverted condition after which the perfecting cylinder transfers the inverted sheet of material to the second transfer cylinder which returns the sheet of material back to the common pressure cylinder with the bottom surface of the sheet of material facing upwards for printing thereon, wherein for inverting the sheet of material, a first end of the sheet of material is gripped by the first transfer cylinder and advanced thereon until a rear end of the sheet of material faces the perfecting cylinder which then grips said rear end and advances the sheet of material on the perfecting cylinder with said bottom surface facing upwards and transfers the inverted sheet of material to the second transfer cylinder.

8. The method of claim 7, wherein said first and second transfer cylinders tangentially contact said perfecting cylinder.

9. The method of claim 7, comprising applying suction from said first transfer cylinder to said rear end of the sheet of material to hold said rear end against said first transfer cylinder.

10. The method of claim 7, wherein said first and second printing means respectively comprise a plurality of printing units for multiple printing on said sheet of material.

11. The method of claim 7, wherein said perfecting cylinder and said first and second transfer cylinders travel at the same relative speed when the sheet of material is being transferred therebetween, and when the sheet of material is on said perfecting cylinder, the perfecting cylinder is driven at a speed corresponding to the length of the sheet of material whereby to enable the satellite-type printing press to print on sheets of material of different length.

12. The method of claim 7, wherein the transfer cylinders and the perfecting cylinder are selectively disabled to enable printing of the sheet of material on one side only.

13. In a satellite-type printing press having a common pressure cylinder on which a sheet of material can be advanced from an upstream station to a downstream station for passage between first and second printing means for color printing on the sheet of material, the improvement comprising means for two-side printing on said sheet of material by said satellite-type printing press comprising:

sheet perfecting apparatus disposed between said first and second printing means for inverting said sheet of material so that the first printing means prints on one side of said sheet of material and the second printing means prints on an opposite side of said sheet of material, wherein said sheet perfecting apparatus comprises first and second sheet transfer cylinders and a sheet perfecting cylinder between said first and second transfer cylinders, wherein after the first printing means has printed on a top surface of the sheet of material, a gripper on the first transfer cylinder grips a front end of the sheet of material to transfer the sheet of material thereon until a rear end of the sheet of material is adjacent to said perfecting cylinder whereupon a gripper on said perfecting cylinder grips the rear end of the sheet of material and advances the sheet of material, rear end first, in inverted condition to the second transfer cylinder which returns the sheet of material to the common pressure cylinder with a bottom surface of the sheet of material facing upwards for being printed by said second printing means.

14. The apparatus of claim 13, wherein said first and second transfer cylinders tangentially contact said common pressure cylinder and said perfecting cylinder is in tangential contact with said first and second transfer cylinders.

15. The apparatus of claim 13, wherein said perfecting cylinder and said first and second transfer cylinders travel at the same relative speed when the sheet of material is being transferred therebetween, and when the sheet of material is on said perfecting cylinder, the perfecting cylinder is driven at a speed corresponding to the length of the sheet of material whereby to enable the satellite-type printing press to print on sheets of material of different length.

16. The apparatus of claim 13, wherein said first transfer cylinder is provided with a suction opening to hold said rear end of the sheet of material against the first transfer cylinder.

17. The apparatus of claim 13, wherein said first and second transfer cylinders rotate in a direction opposite said common pressure cylinder and said perfecting cylinder rotates in the same direction as said common pressure cylinder.

* * * * *

UNITED STATES PATENT AND TRADEMARK OFFICE

CERTIFICATE OF CORRECTION

PATENT NO. : 6,851,360 B2
DATED : February 8, 2005
INVENTOR(S) : Masayuki Iwamoto It is certified that error appears in the above-identified patent and that said Letters Patent is hereby corrected as shown below:

Title page,
Item [75], Inventors, "Iwamloto" should read -- Iwamoto --.

Signed and Sealed this

Tenth Day of May, 2005

JON W. DUDAS
*Director of the United States Patent and Trademark Office*